US005557997A

United States Patent [19]

Wunderlich et al.

[11] Patent Number: 5,557,997

[45] Date of Patent: Sep. 24, 1996

[54] APPARATUS FOR TRANSVERSE CUTTING

[75] Inventors: Gary R. Wunderlich; Larry D. Wierschke, both of Green Bay, Wis.

[73] Assignee: Paper Converting Machine Company, Green Bay, Wis.

[21] Appl. No.: 223,543

[22] Filed: Apr. 6, 1994

[51] Int. Cl.[6] ..... B26D 1/58

[52] U.S. Cl. ..... 83/174; 83/327; 83/329; 83/337; 83/698.51

[58] Field of Search ..... 83/329, 337, 471.1, 83/471.3, 473, 490, 174, 327, 698.51

[56] References Cited

U.S. PATENT DOCUMENTS

| | | | |
|---|---|---|---|
| Re. 30,598 | 5/1981 | Spencer . | |
| 1,746,594 | 2/1930 | Jacobson | 83/471.3 |
| 1,784,443 | 12/1930 | Hohn | 83/329 |
| 2,140,720 | 12/1938 | Ruau | 83/329 |
| 2,704,560 | 3/1955 | Woessner | 83/473 |
| 2,752,999 | 7/1956 | Gage . | |
| 2,776,566 | 10/1956 | Gage . | |
| 2,779,413 | 1/1957 | Gage . | |
| 2,833,024 | 5/1958 | Boehm et al. | 83/329 |
| 2,879,633 | 3/1959 | Gage . | |
| 3,049,954 | 8/1962 | Barlament . | |
| 3,213,731 | 10/1965 | Renard . | |
| 3,213,734 | 10/1965 | Nystrand . | |
| 3,218,898 | 11/1965 | Briscoe | 83/337 |
| 3,292,470 | 12/1966 | Nystrand . | |
| 3,380,331 | 4/1968 | Boothe, Jr. et al. | 83/490 |
| 3,905,260 | 9/1975 | Nystrand . | |
| 4,065,880 | 1/1978 | Maw . | |
| 4,173,846 | 11/1979 | Steiner et al. . | |
| 4,347,771 | 9/1982 | Bradley . | |
| 4,584,917 | 4/1986 | Blom . | |
| 4,821,613 | 4/1989 | Hertel . | |
| 4,914,997 | 4/1990 | Belvederi | 83/329 |
| 5,038,647 | 8/1991 | Biagiotti . | |
| 5,152,203 | 10/1992 | Wierschke . | |
| 5,289,747 | 3/1994 | Wunderlich . | |
| 5,315,907 | 5/1994 | Biagiotti . | |

FOREIGN PATENT DOCUMENTS

| | | | |
|---|---|---|---|
| 555190 | 2/1993 | European Pat. Off. . | |
| 930737 | 1/1955 | Germany . | |
| 452180 | 8/1936 | United Kingdom | 83/490 |

*Primary Examiner*—Eugenia Jones
*Assistant Examiner*—Charles Goodman
*Attorney, Agent, or Firm*—Tilton, Fallon, Lungmus & Chestnut

[57] ABSTRACT

A compensating linkage for a continuous motion saw for elongated web plies wherein a skew arm is pivotally connected at its ends to a drive arm and where the drive arm at its ends carries disc blades and sharpening grinding stones for the blades, the ends of the drive arm being pivotally connected for two degrees of freedom with brackets which in turn are connected to an eccentrically mounted control arm, the linkage resulting in compensation for the skew angle to provide a cut perpendicular to the movement of the web plies and reduction of centrifugal forces and elimination of cyclic centrifugal loading on the blade grinding systems.

17 Claims, 5 Drawing Sheets

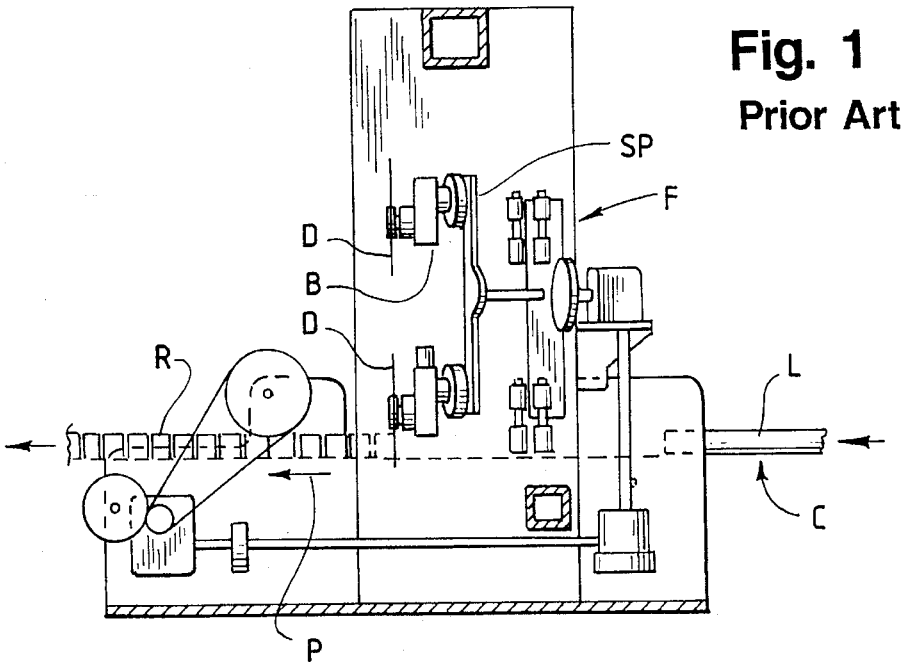
Fig. 1
Prior Art
Fig. 2 Prior Art
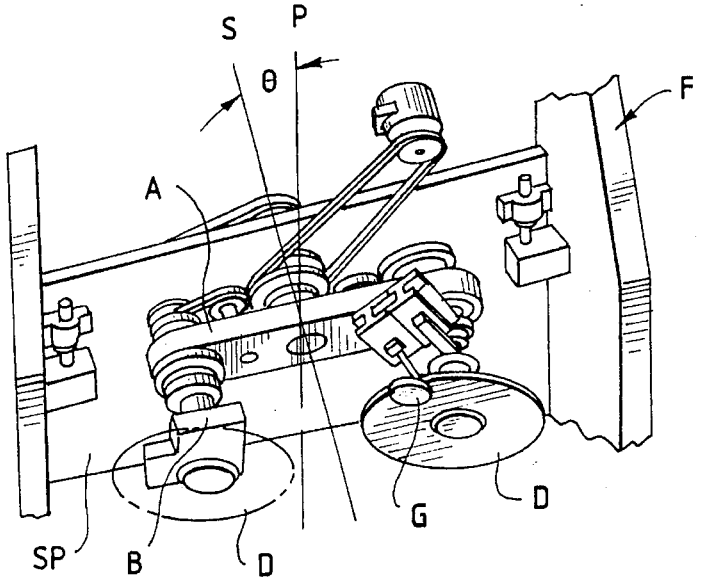
Fig. 3
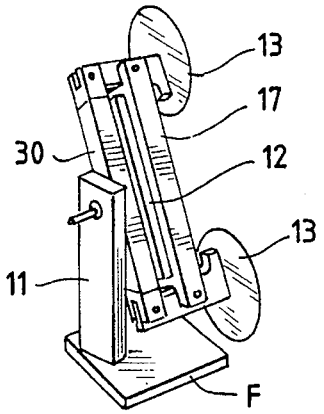

APPARATUS FOR TRANSVERSE CUTTING

This invention relates to apparatus for transverse cutting and, more particularly, to a continuous motion saw of the nature shown and described in co-owned Patent RE. 30,598.

BACKGROUND AND SUMMARY OF INVENTION

A continuous motion saw is designed to cut a product in motion. Illustrative products are "logs" of bathroom tissue and kitchen toweling. The invention, however, is not limited to such products but can be used to advantage on other multi-ply products, such as bolts of facial tissue, interfolded or otherwise.

The illustrative products, for example, are produced at high speed on machines termed "rewinders". These machines start with a parent roll perhaps 10 feet long and 8 feet in diameter—resulting from the output of a paper-making machine. The parent roll is unwound to provide a web which is usually transversely perforated (in the U.S. on 4½" centers for bathroom tissue and 11" centers for kitchen toweling and then rewound into retail size rolls of 4"–8" in diameter. Conventional high speed automatic rewinders can produce upwards of 30 logs per minute. These logs then are delivered to a log saw where they are moved axially for severing into retail size lengths—again normally 4½" for bathroom tissue and 11" for kitchen toweling. This results in the well-known "squares" of tissue and toweling.

To have a saw capable of keeping up with high speed rewinders it is necessary to cut the log while it is in motion. To achieve a "square" cut on the moving log, the blade must have a cutting motion perpendicular to the log while also having a matched component of motion parallel of the log travel. To produce this combined motion, the orbit centerline of the blade is "skewed" with respect to the log center line. This skew angle is increased for "Long cut" lengths and is decreased for "short cut" lengths.

Even though the saw head is mounted at this skewed angle, the blades must always remain perpendicular to the log to provide a square cut. This required that the blades be mounted on an angled housing (equal and opposite to the skew angle) and driven by a 1:1 planetary motion to maintain their perpendicular relation to the log as the main arm rotates.

It was also necessary to maintain a razor-like sharpness on the cutting edge of the blades. To do this, the grinding system must be mounted on the angled housings and follow the planetary motion. Because the grinders are mounted out on the blade's edge, each blade/grinder assembly is difficult to balance, especially due to the changing position of the grinders as the blade diameter decreases. Since the system was generally out of balance, the planetary gear train had to deal with the constant imbalance torque and its cyclic nature, reversing once each revolution. The planetary motion also put the grinder into completely reversing cyclic loading causing component fatigue and grind quality problems as production speed requirement increased.

Problems were also associated with changing the skew angle to produce various product lengths. After changing the framework of the saw to a new skew angle, the blade mounting and drive components had to be replaced. The angled block mounting the blade had to be changed to return the blades back to perpendicular and the bevel gears inside it that were used to drive blades had to be changed to continue to match the angled housing.

These all combined to produce a complex cutterhead assembly that make changing skew angles an involved and time-consuming process. This system has also proven to be complex causing high maintenance due to a complex blade drive and blade orienting planetary system. The design was also speed limiting due to the planetary motion of the grinders causing cyclic loading and the requirement that the grinders follow the same orbit radius of movement as the blades, causing them to have to withstand full centrifugal loading The problem, therefore, was to produce this same type of blade action but without the use of planetary motion. For this, the invention provides a motion that allows for locating of the grinders at a lesser orbit radius than the blade center and leaves them always toward the center of rotation, thereby eliminating the cyclic centrifugal forces. At the same time, the invention provides the ability to change the skew angle quickly, even automatically, with no change parts.

According to the invention in the specific embodiment illustrated, the blade, blade drive motor, and grinding stone assemblies are mounted on the same mounting pivot bracket. One bracket is mounted on each end of a rotating drive arm. Directly behind the arm is a control arm linkage connecting the two brackets from behind. The linkage, which has tie rod characteristics, is mounted off-center to the orbit head assembly center of rotation causing the blade and grinding stone mounting pivot brackets to oscillate back and forth as the arm rotates. This action allows the blades to follow an eccentric pattern with respect to the axis of rotation to keep them perpendicular with the log or folded web. The entire orbit head assembly is mounted skewed with respect to the log or folded web. The amount of eccentricity is dependent on the skew angle of the orbit head assembly and the skew angle is dependent on the linear speed of the log or folded web in order to achieve the desired square cut-off. The movable eccentric in this invention is also advantageous to bring the blades back to perpendicular as the skew angle changes correcting for changes of head skew. The amount of head skew is regulated through the use of two skew adjustment linkages that the orbit head assembly is mounted on. It could be done manually or automatically with sensors and drive motors which would allow changing the rate of feed of the log or folded web on the fly.

In principle, the inventive continuous motion saw and method includes a frame providing a linear path or elongated web plies and conveyor means operatively associated with the frame for advancing the elongated web plies along the linear path. The frame also has a blade-equipped drive arm rotatably mounted thereon with means for rotating the drive arm about an axis skewed with respect to the linear path. A bracket is connected adjacent an end of the drive arm for two degrees of pivotal movement, the bracket or brackets also carrying the blade or blades. Means are provided on the bracket for rotating the blades. Thus, rotation of the blade arm orbits the blade or blades and the orbit resulting therefrom intersects the path. The invention further includes a control arm rotatably mounted on the frame adjacent the blade arm for rotation about an axis eccentric to the blade arm axis. The control arm adjacent the end or ends thereof is connected to the bracket or brackets again for two degrees of pivotal freedom so that rotation of both of the arms orients the blade or blades perpendicular to the linear path. This eliminates the planetary motion of the prior art and allows for the grinding stone assemblies to remain close to the center of rotation of the cutter head assembly— thereby reducing the centrifugal forces of the system and eliminating the cyclic nature of the force, thereby allowing for greater speeds. The new simplified construction which has the motor, blade and grinding assembly all attached to one pivot bracket and connected to a drive and control arm offers a more user-friendly system with fewer parts, lower cost, less maintenance, greater speeds and more versatility.

The invention is described in conjunction with an illustrative embodiment in the accompanying drawing.

BRIEF DESCRIPTION OF DRAWING

FIG. 1 is a schematic side elevational view of a continuous motion saw according to the prior art;

FIG. 2 is a fragmentary perspective view of a continuous motion saw according to the prior art;

FIG. 3 is a schematic perspective view of a model featuring the teachings of the instant invention;

DETAILED DESCRIPTION

Prior Art

Figure 4:
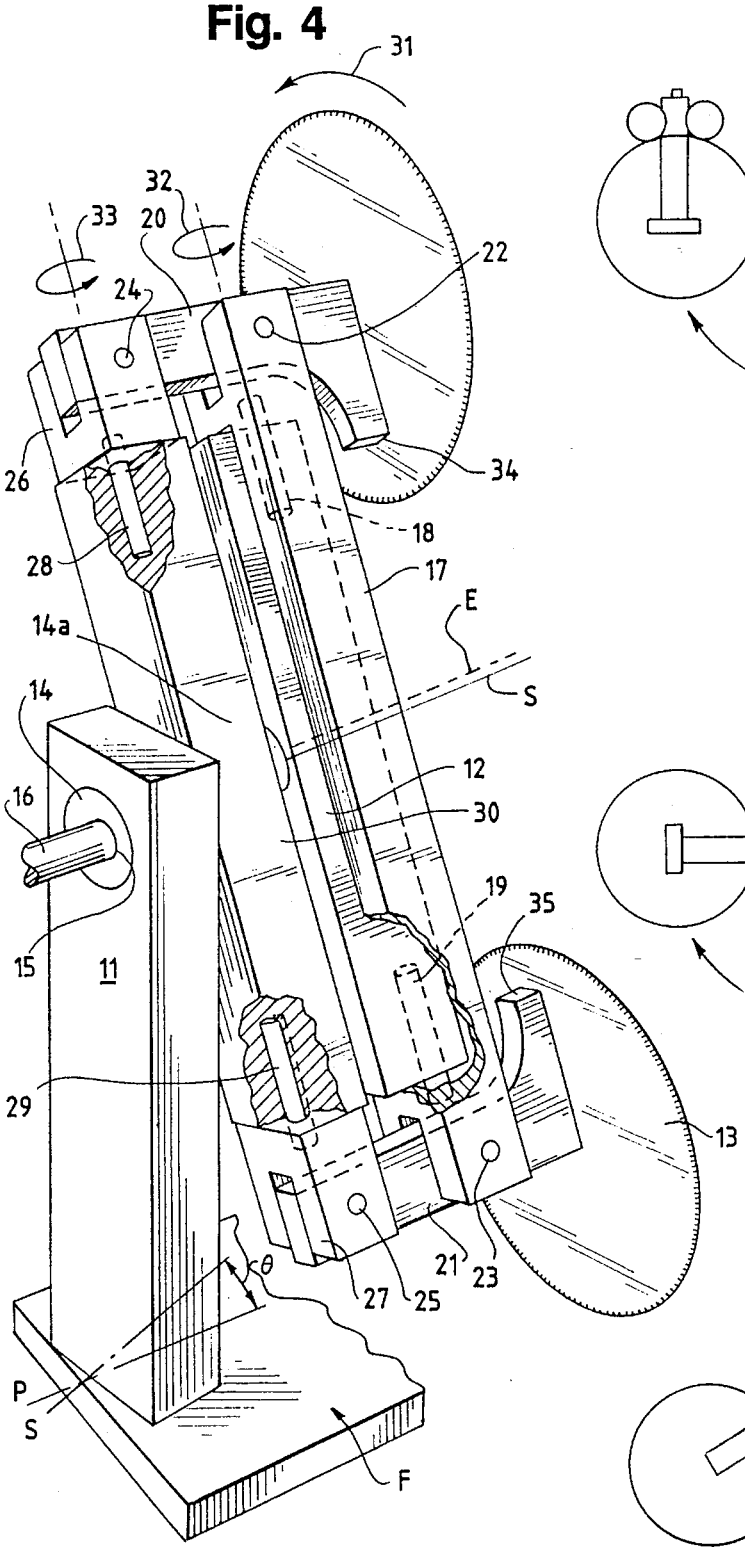
FIG. 4 is an enlarged version of FIG. 3.

Referring first to FIG. 1 the symbol F designates generally the frame of the machine which can be seen in FIG. 2 to include a pair of side frames.

The frame F provides a path P which extends linearly, horizontally for the conveying of logs L and ultimately the severed rolls R. The logs and thereafter the rolls are conveyed along the path P by a suitable conveyor generally designated C. The symbol B designates generally the blade mechanism which includes two disc blades D—see also FIG. 2. As can be seen from FIG. 2, there is provided a bracket for each blade as at B which support the usual grinders G.

The blades B and their associated structure are carried by a skew plate SP which supports the skew arm A for rotation about a skew axis S which is arranged at a minor acute angle $\phi$ to the path P (see the upper central portion of FIG. 2).

The Invention

The invention is first described in conjunction with a model in FIG. 3. This permits the description of the basic components free of many of the details present in the commercial machine of FIGS. 7–10.

In FIG. 3, the symbol F again designates generally a frame which provides a support for the skew plate now designated 11. As before, the skew plate 11 carries skew arm 12 which in turn ultimately provides a support for orbiting, rotating disc blades—here the blades are designated 13 versus D in the prior art showing. As can be appreciated from what has been said before, here the similarly ends between the invention and the prior art. In particular, there is considerably more involved in compensating for the skew angle$\phi$ between the axis S of arm rotation and the path P. Instead of having the blades 13 fixed at the compensating angle $\phi$ as were the disc blades D in FIGS. 1 and 2, the invention makes the compensation by employing an eccentric and pivotal connections providing two degrees of pivotal freedom. For example, the prior art machine utilized gears that were angled so as to maintain the disc blades D always perpendicular to the path P. This brought about the problems previously discussed—complexity of machinery and heavy cyclic "g" loads in particular.

Showing of FIG. 4

In the invention as seen in the model showing of FIG. 4, the eccentricity is provided by a cylindrical bearing 14 having an eccentric bore 15. The bearing 14 is fixed in the skew plate 11. Extending through the off-center bore 15 is a drive shaft 16 which is fixedly coupled to the skew arm 12. As indicated previously, the skew arm 12 does not itself carry the disc blades 13 but does so through the drive arm 17 which is pivotally connected as at 18, 19 to the ends of the skew arm 12.

Inasmuch as the skew arm 12 is fixedly connected to the drive shaft 16 perpendicular thereto—it rotates in a plane which is skewed relative to the path P, i.e., perpendicular to the axis S. The skew arm 12 is pivotally connected to the drive arm 17 via longitudinally-extending pivot posts 18, 19—see the designations between the upper and lower disc blades 13. In turn, the clevis-like ends of drive arm 17 are pivotally connected to brackets 20 and 21 via transversely-extending pivot rods 22, 23—just to the left of blades 13.

At their ends opposite the blades 13, the brackets 20, 21 are pivotally connected via transversely-extending pivot rods 24, 25 to the clevises 26, 27—see the left side of FIG. 4.

These clevises, in turn are pivotally connected via longitudinally-extending pivot posts 28, 29 to the control arm 30—also designated in FIG. 3.

The control arm 30, in turn, is eccentrically mounted relative to the drive shaft 16 on bearing 14—see the central left portion of FIG. 4.

It is the combination of the drive arm 17, the brackets 20 and 21 and the control arm 30 that compensates for the skew angle $\phi$ and positions the blades 13 perpendicular to the path P so as to provide a "square" cut. But, unlike the prior art '598 patent, this is not done by making a single compensation (via gears in the bracket B) but is done by using an eccentric plus connections that provide at least two degrees of rotational or pivotal freedom. This can best be appreciated from a description of what happens when the upper one of the blades 13 travels in the direction of the arrow 31 from a 3 o'clock position—as in the right hand portion in FIG. 6—to the 6 o'clock position.

OPERATION

As a blade 13 orbits from the 3 o'clock position toward cutting contact with a log, the drive arm 17 pivots relative to the skew arm 12—this on the pivot posts 18, 19 as indicated by the arrow 32. At the 3 o'clock position, the descending end of the control arm 30 is in its furthest position from the skew axis S, i.e., the axis of the shaft 16. This can be appreciated from the location of the eccentric bore 15—see the left side of FIG. 4. Then, as the control arm 30 continues to rotate—by virtue of being coupled to the skew arm 12, through brackets 20, 21 and drive arm 17—the descending end of the control arm 30 comes closer and closer to the skew axis S, and is closest at the 9 o'clock position. The other end of the control arm 30 follows the same pattern.

What this means is that the contribution of the eccentric mounting of the control arm 30 toward compensating for skew varies, i.e., decreases in going from the 3 o'clock position to the 9 o'clock position. This results in the control arm 30 pulling the bracket 20 about the pivot post 28. This pivot post is in the clevis 26 and the bracket 20 and the movement is designated by the arrow 33.

This necessarily occurs because the control arm 30, the clevis connection 26, the bracket 20, the drive arm 17 (with skew arm 12), bracket 21 and clevis 27 form, in essence, a generally planar four-bar linkage. This also includes the pivots 24, 22, 23 and 25 in proceeding clockwise around the four-bar linkage. And this linkage is fixed in the plane of rotation just described because the downstream end of the shaft 16 is fixed to the skew arm 12 which in turn is fixed against longitudinal movement in the drive arm 17. Thus, the pivots 18, 19, 28, 29 are generally parallel to the length of the drive arm 17 and the pivots 22, 23, 24 and 25 are generally perpendicular to the linkage plane.

However, at the same time, there is a rotation about the longitudinally-extending pivot posts 18, 19 at the ends of the skew arm 12 and also the counterpart longitudinally-extending pivot posts 28, 29 at the ends of the control arm 30. This necessarily occurs because the eccentric mounting of the control arm 30 on the bearing 14 produces a rectilinear movement of the control arm 30.

This extra component results in a twisting of the drive arm 17 (permitted because of the pivotal connection with the skew arm 12) and which is reflected in changing the orientation of the brackets 20, 21 and, hence the blades 13. So the inventive arrangement compensates for the departure of the blades from "squareness" by virtue of being skewed by the eccentricity of the drive shaft 16 and its coupling to a four-bar linkage. There are other ways of pivotally coupling the various members of the four-bar linkage—in particular, substituting at least a universal or spherical joint for the pivots 24, 28 and 25, 29.

Advantage Relative to "g" Forces

Figure 5:
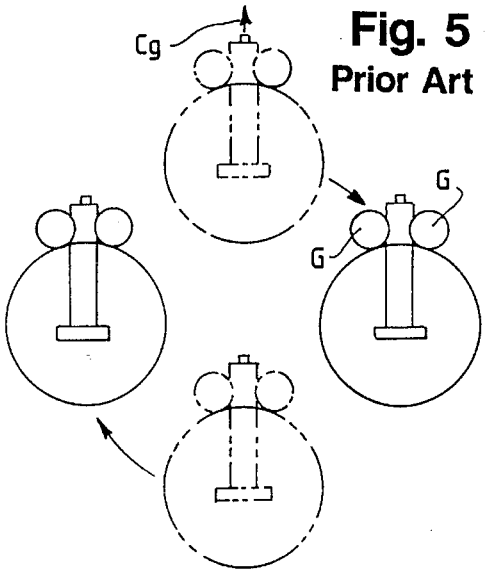
Fig. 5 Prior Art
FIG. 5 is a schematic view showing the orbiting of a blade according to the prior art continuous motion saw.
Figure 6:
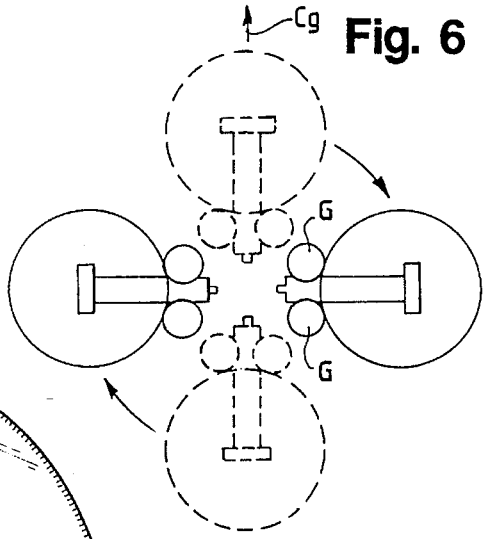
FIG. 6 is a view similar to FIG. 5 but featuring the orbiting of the instant inventive saw.

Reference now is made to FIGS. 5 and 6 which illustrate a significant advantage of the invention. In FIG. 5 for example, the grinders G—see also FIG. 2—maintain the same relationship to the frame throughout the orbit of the blades B, i.e., always being above the blades B. This results in a constantly changing force on the grinders. For example, at a planetary motion speed of 200 rpm the acceleration force $C_g$ due to centrifugal movement is 27.5 times "g". In contrast, in FIG. 6 while maintaining the same blade sweep radius and where the grinders do not follow a planetary movement but are always oriented in the same distance from the axis of rotation of the blades, the force $C_g$ is only 21.5 times "g" and this at higher 250 rpm. This results from the grinders being mounted on the brackets 20 and 21 as at 34 and 35, respectively. There was no such arrangement in the prior art. Thus, the invention provides a significant advantage in first lowering centrifugal forces and second in maintaining a force that is in a constant direction relative to the grinders.

Figure 6A:
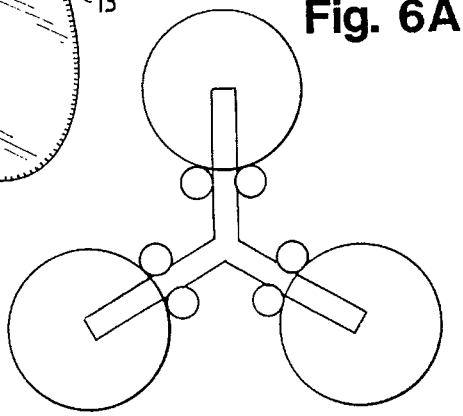
FIG. 6A is a view similar to FIG. 6 but of a modified embodiment of the invention.

It will be appreciated that the invention finds advantageous application to saws with one or more blades. The usual arrangement is with two blades as seen in FIG. 6. However, more blades can be used—as, for example, the three blade version of FIG. 6A. This is advantageous either with or without the four-bar linkage compensation for skew. The inboard placement is helpful itself in reducing centrifugal forces and substantially eliminating cyclic loading.

The invention has been described thus far in connection with a schematic model. Now the description is continued in connection with an embodiment suitable for commercial usage—this is in connection with FIGS. 7–10.

Embodiment of FIGS. 7–10

Here like numerals are employed as much as possible to designate analogous elements—but with the addition of 100 to the previously employed numeral. Thus, looking at FIG. 7 in the lower left hand portion, it will be seen that the numeral 111 designates the skew plate which is shown fragmentarily. This has rigidly fixed therein the bearing 114 (see the central portion of FIG. 7) which rotatably carries the drive shaft 116—see the lower left hand portion of FIG. 7. Moving upwardly at the left of FIG. 7, we see the drive shaft 116. Affixed to the right hand end of drive shaft 116, as at 116*a*, is the skew arm 112—seen in solid lines in the broken away portion of the drive arm 117.

As before, there are pivot post connections between the skew arm 112 and drive arm 117 as at 118 at the top and 119 at the bottom. At its upper end, the drive arm 117 is equipped with a transversely extending pivot rod as at 122 and which connects the drive arm 117 to the upper bracket 120. In similar fashion, the pivot rod 123 connects the lower end of the drive arm 117 to the lower bracket 121.

Figure 7:
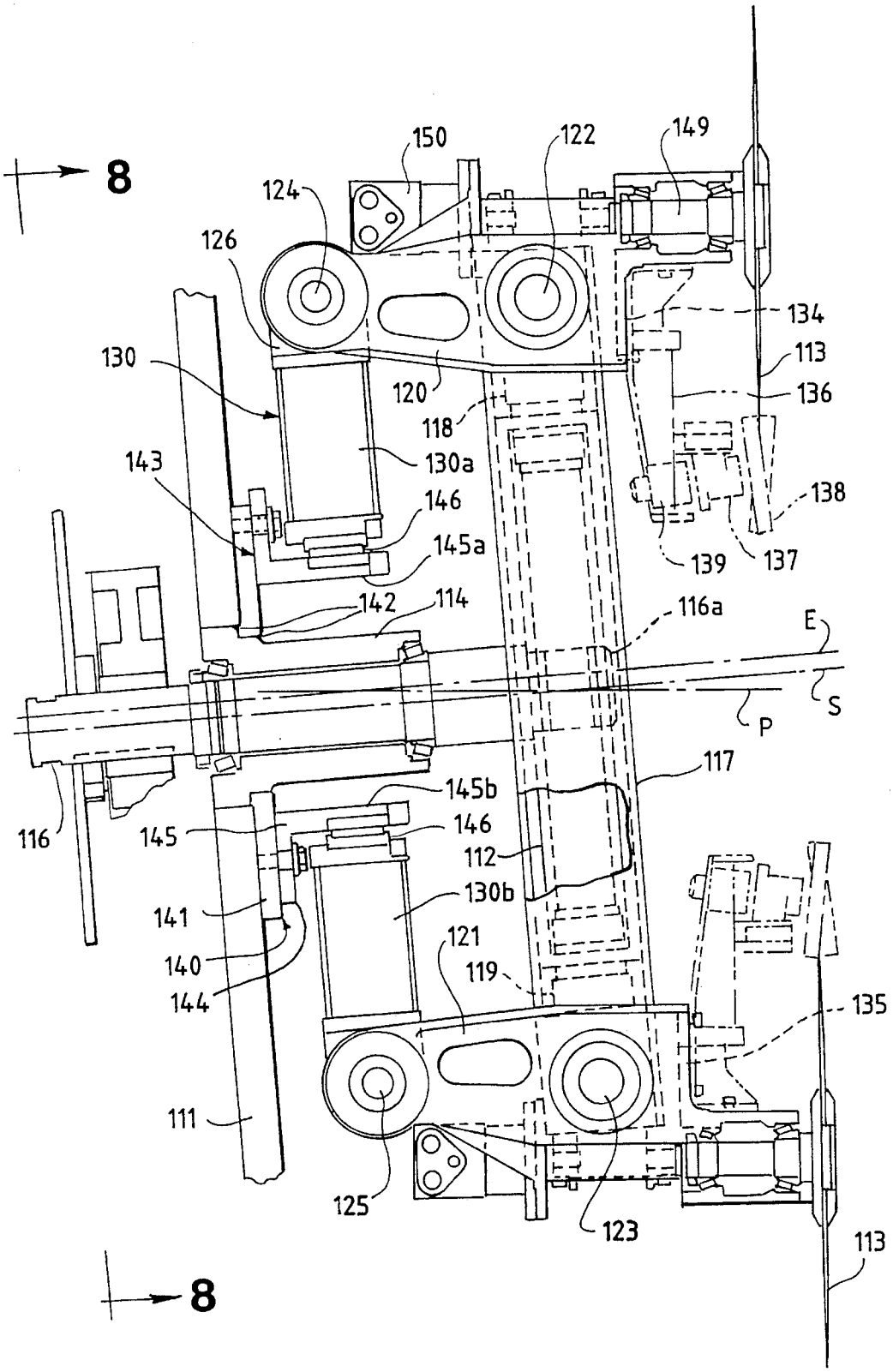
FIG. 7 is a top plan of a commercial embodiment of the inventive saw.

Now considering the left hand end of the bracket 120 (in the upper left hand portion of FIG. 7), the numeral 124 designates a transversely extending pivot rod pivotally attached to bearing housing 126 mounted on the upper end 130*a* of the control arm generally-designated 130. Here, it will be noted that the control arm 130 is somewhat different from the straight control arm 30 of the model of FIGS. 3 and 4 in that it has two parts, each associated with a different bracket as seen in FIG. 7—120 at the upper end 130*a* and 121 at the lower end 130*b*. In between, the parts are connected by an enlargement to accommodate the eccentric means as seen in FIG. 8.

Figure 8:
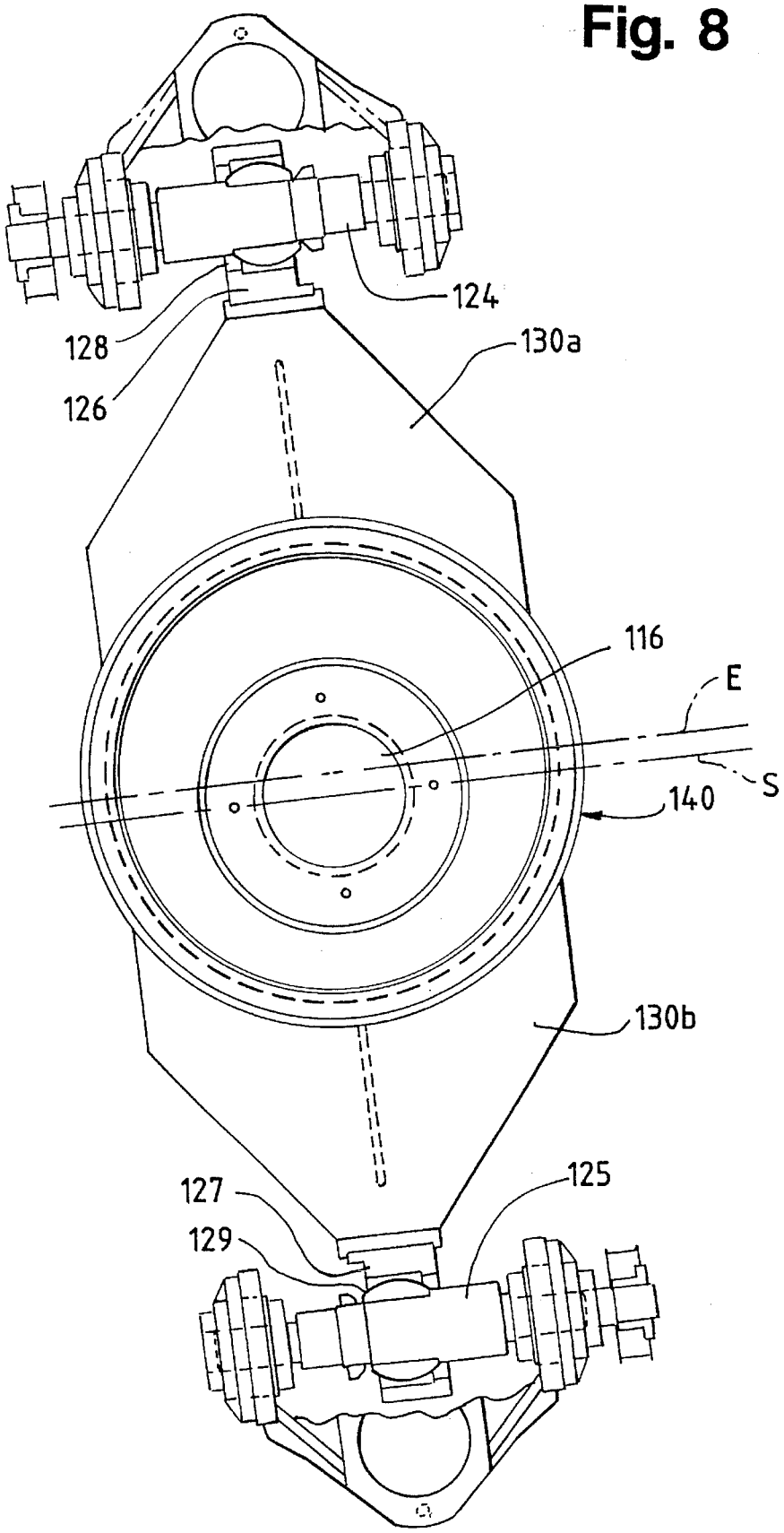
FIG. 8 is a rear or upstream view of the saw as seen along the sight line 8—8 of FIG. 7; and without the skew plate III

The connection between the upper control arm end 130*a* and the bearing housing 126 can be best seen in the upper portion of FIG. 8 where the pivot rod 124 is also designated—as is the longitudinally extending pivot mounting 128. An arrangement similar thereto is provided at the lower end 130*b* of the control arm 130 as seen in FIG. 8 where the cross pivot is designated 125, the longitudinally extending pivot mounting 129 and the bearing housing 127.

Now returning to FIG. 7, it will be seen in the upper right hand corner that there is a mounting surface provided at 134 and which carries the grinder associated with the upper disc blade 113. In similar fashion, a surface 135 is provided in the lower right hand portion of FIG. 7 for sharpening the other blade 113. Because the constructions are the same for the upper and lower grinders and disc blades, only the one shown in the upper position in FIG. 7 will be described. Boltably secured to the surface 134 is a bracket or arm member 136. This carries a bearing 137 which in turn rotatably carries a shaft for the grinding stone 138. A motor 139 powers the grinding stone 138 to provide a beveled edge for the upper disc blade 113.

Adjustable Eccentric

In the central left hand portion of FIG. 7, the numeral 140 designates generally the assembly of elements which provide the adjustable eccentric. These include a plate 141 which is secured to the skew plate 111 by the circular welds 142.

Positionably mounted on the plate 141 is an eccentric bearing generally designated 143. The bearing 143 is annular and has a flange portion as at 144 confronting the plate 141 and a cylindrical-like portion 145 which surround the bearing 114 in spaced relation thereto.

That the bearing 143 is eccentric to the bearing 114 can be appreciated from the fact that the upper portion as at 145*a* (still referring to the central portion of FIG. 7) is further from the bearing 114 than is the lower portion 145*b*.

Interposed between the cylindrical portion 145 and the control arms 130 is a ring bearing as at 146. Thus, when the control arm 130 is moved by the brackets 120, 121 under the force exerted by the rotating arms 112, 117, the upstream ends of the brackets 120, 121 move in an eccentric fashion. Thus far, the structure described is the counterpart of that previously described in conjunction with FIG. 4 where the control arm 130 has its ends following an eccentric path based upon the eccentricity of the bearing 14 relative to the drive shaft 16, viz., the difference between axes E and S in FIGS. 4 and 7. The control arm 30 is journalled on the bearing 14 for free rotation thereon—and this can be appreciated from the fact that the bearing 14 continues through the control arm 30 as can be appreciated from the portion of the bearing designated 14*a* in FIG. 4—see the right central portion of FIG. 4. Added to the commercial embodiment is the ability to adjust the eccentricity.

Eccentric Adjustment

Figure 9:
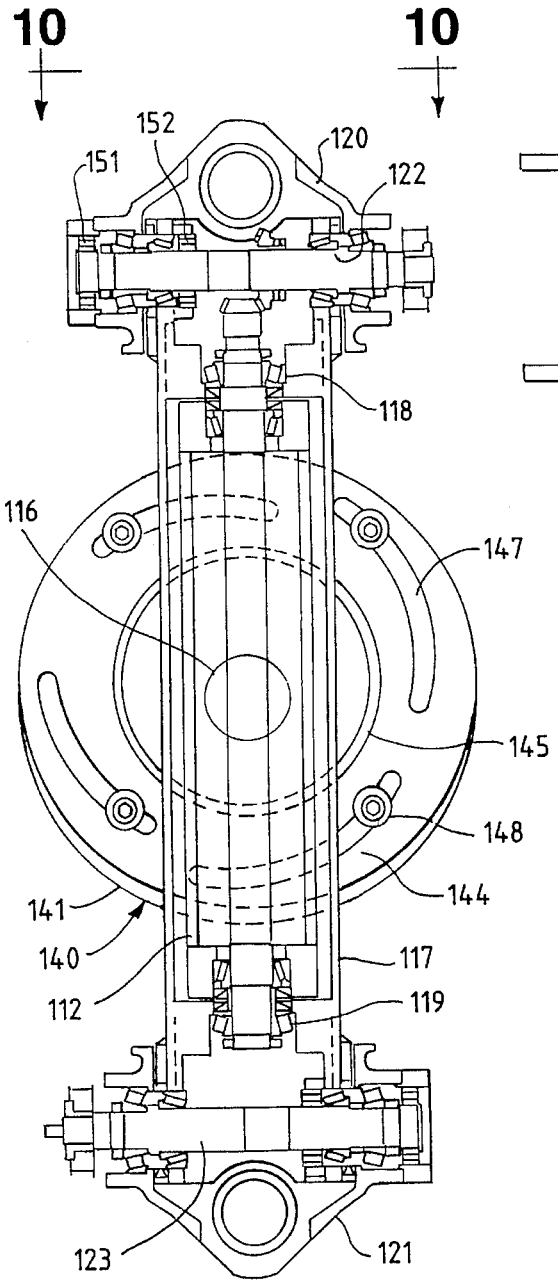
FIG. 9 is a front or downstream view of the saw as seen along the sight line 9—9 of FIG. 7.

The adjustable feature for the eccentric 140 can be best appreciated first from a consideration of FIG. 9. There, it is seen that the flange or hub portion 144 is equipped with four arcuate slots 147, each of which receives a cap screw 148. The cap screws are further received within tapped openings in the plate 141 and when the cap screws are loosened, the hub or flange portion 144 of the bearing 143 can be "dialed" to the desired position and thus change the eccentricity of the control arm 130. It will be appreciated that the rotation of the eccentric could be achieved by pushbutton means using automatic clamp bolts at 148 and means for turning the flange 144. Thus, adjustment could be done while the saw is operating, using further means for turning the skew plate 111 to the new skew angle.

The curved slots 147 produce an 8:1 change in eccentricity. Where lesser ratios are permissible, a rack and pinion system may be employed to obtain a 2:1 ratio. A plain linear slide, using a track with jacking screws and clamps, can provide a 1:1 ratio.

Although the invention has been described in conjunction with the usual two bladed continuous motion saw, it will be appreciated that the advantages of the invention may be applied to saws with one, three or four blades inasmuch as the invention permits a balancing of forces through the geometry of the controlling linkage. With a single blade, for example, a suitable counterweight is provided on the arm end lacking the blade.

Figure 10:
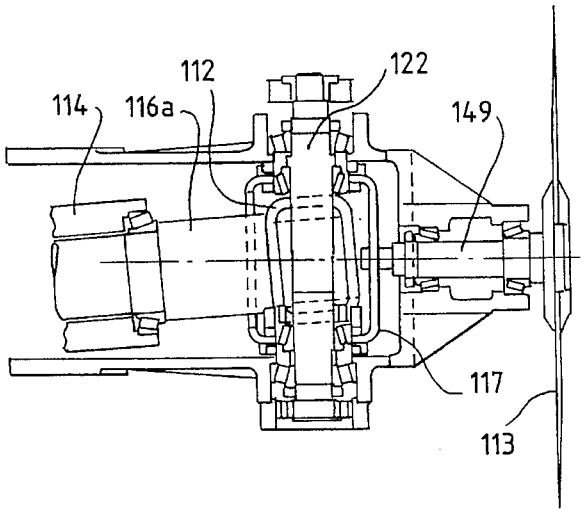
FIG. 10 is an end elevation of the saw as would be seen along the line 10—10 of FIG. 9.

The blade structure can be readily appreciated from a consideration of both the upper portion of FIG. 7 and FIG. 10. In FIG. 7, the disc blade 113 is carried on a spindle or shaft 149 and is suitably rotated by means of a motor 150.

Another structural feature found to be advantageous is the provision of a pair of one way clutches 151, 152—see FIG. 9 relative to the upper pivot shaft 122. These allow the pivot shafts to turn forward with brackets 120 and 121 but do not allow the shafts to follow the bracket backwards. This, in turn, causes the pivot shafts and associated bearings to maintain a constant forward index motion reducing cyclic motion wear problems which occur when bearings are simply oscillated. Without the one-way clutches, the pivot shafts would return to original orientation each saw revolution. This would result in wear on the bearing in one sector.

While in the foregoing specification a detailed description of an embodiment of the invention has been set down for the purpose of illustration and compliance with the statute, many variations in the details hereingiven may be made by those skilled in the art without departing from the spirit and scope of the invention.

We claim:

1. A continuous motion saw for elongated web plies, comprising: frame means providing a linear path for said elongated plies, conveyor means operatively associated with said frame means for advancing said elongated web plies along said linear path, a relatively elongated drive arm rotatably mounted on said frame means, a blade mounted on said drive arm, means on said frame means for rotating said drive arm about an axis skewed with respect to said linear path, bracket means mounted adjacent an end of said drive arm to provide two degrees of pivotal freedom and carrying said blade, means on said bracket means for rotating said blade, rotation of said drive arm orbiting said blade and the blade orbit intersecting said linear path, and control means rotatably mounted on said frame means for rotation about an axis eccentric to said drive arm axis, said control means comprising a control arm connected to said bracket means for compensating for the skew of said drive arm to orient said blade perpendicular to said web plies in said linear path when engaging the same, said two degrees of pivotal freedom of said bracket means including means providing first for rotation about a first axis generally parallel to the length of each of said drive arm and said control arm and second for rotation about a second axis perpendicular to said first axis and generally perpendicular to said skewed axis, said rotation-providing means including clutch means to maintain a constant forward index motion.

2. The saw of claim 1 in which said bracket means is equipped with a grinding stone for said blade, said grinding stone being positioned radially inwardly of said blade during the entire blade orbit whereby centrifugal forces are reduced and cyclic loading is substantially eliminated.

3. The saw of claim 1 in which said drive arm, bracket means and control means make up a generally planar four-bar linkage with said two degrees of pivotal freedom being (a) generally parallel to the length of said drive arm and (b) generally perpendicular to the plane of said generally planar four-bar linkage.

4. A continuous motion saw for elongated web plies, comprising: frame means providing a linear path for said elongated web plies, conveyor means operatively associated with said frame means for advancing said elongated web plies along said linear path, a relatively elongated drive arm rotatably mounted on said frame means, a blade mounted on said drive arm, means on said frame for rotating said drive arm about an axis skewed with respect to said linear path, a bracket connected adjacent an end of said drive arm to provide two degrees of pivotal freedom and carrying said blade, means on said bracket for rotating said blade, rotation of said drive arm orbiting said blade and the blade orbit intersecting said linear path, and a control arm rotatably mounted on said frame means adjacent said blade drive arm for rotation about an axis eccentric to said drive arm axis, and end of said control arm connected to said bracket for two degrees of pivotal freedom, the rotation of both of said arms orienting said blade perpendicular to said linear path, said two degrees of pivotal freedom of said bracket including means providing first for rotation about a first axis generally parallel to the length of each of said drive arm and said control arm and second for rotation about a second axis perpendicular to said first axis and generally perpendicular to said skewed axis, said rotation-providing means including clutch means to maintain a constant forward index motion.

5. A continuous motion saw for cutting elongated web plies into lengths, comprising: frame means providing a linear path for said elongated web plies, conveyor means operatively associated with said frame means for advancing said elongated web plies along said linear path, a relatively elongated drive arm rotatably mounted on said frame means, means on said frame for rotating said drive arm about an axis skewed with respect to said linear path, a pair of brackets, one said bracket connected adjacent each end of said drive arm to provide two degrees of pivotal freedom, a blade mounted on each bracket, means on each bracket for rotating its associated blade, rotation of said drive arm orbiting said blades and the orbit of said blades intersecting said linear path, and a control arm rotatably mounted on said frame means adjacent said drive arm for rotation about an axis eccentric to said drive arm axis, each end of said control arm connected to one of said brackets for two degrees of pivotal freedom, the rotation of both of said arms orienting said blade perpendicular to said linear path, each said bracket connecting each drive arm end with an end of said control arm, said two degrees of pivotal freedom of each bracket including means providing first for rotating about a first axis generally parallel to the length of each of said drive arm and aid control arm and second for rotation about a second axis perpendicular to said skewed axis, said rotation-providing means including clutch means to maintain a constant forward index motion.

6. The saw of claim 5 in which means are interposed between said control arm and frame means for adjusting the eccentricity of said control arm axis relative to said drive arm axis for changing the cut length of said elongated web plies.

7. The saw of claim 6 in which a skew plate is mounted on said frame means to define said skew axis, said means for rotating said drive arm including a drive shaft rotatably mounted in said skew plate and carrying said drive arm, said adjusting means including bearing means for said control arm, said bearing means being rotatably mounted on said skew plate for adjusting said eccentricity.

8. The saw of claim 7 in which said bearing means has an arcuate slot-equipped flange to provide for adjusting said eccentricity.

9. The saw of claim 5 in which each bracket is equipped with a grinding stone for each blade, each said grinding stone being positioned radially inwardly of its associated blade during the entire blade orbit whereby centrifugal forces are reduced and cyclic loading is substantially eliminated.

10. A continuous motion saw for elongated web plies, comprising:

a frame providing a linear path for said elongated web plies, conveyor means operatively associated with said frame for advancing said elongate web plies along said linear path, a blade-equipped relatively elongated drive arm rotatably mounted on said frame, means on said frame for rotating said drive arm about an axis skewed with respect to said linear path, a pair of brackets, one said bracket connected adjacent each drive arm end for two degrees of pivotal freedom and carrying a blade, means on each said bracket for rotating each said blade whereby rotation of said drive arm orbits said blades and the blade orbit intersects said linear path, a control arm rotatably mounted on said frame adjacent said drive arm for rotation about an axis eccentric to said drive arm axis, said control arm adjacent each drive arm end being connected to one of said brackets for said two degrees of pivotal freedom whereby the rotation of both of said arms orients said blades perpendicular to said linear path, and each bracket being equipped with grinding stone means for each blade, each said grinding stone being positioned radially inwardly of its associated blade, said two degrees of pivotal freedom of each bracket including means providing first for rotation about a first axis generally parallel to the length of each of said drive arm and said control arm and second for rotation about a second axis perpendicular to said first axis and generally perpendicular to said skewed axis, said rotation-providing means including clutch means to maintain a constant forward index motion.

11. The saw of claim 10 in which said frame is equipped with a skew plate, said means for rotating said drive arm including a drive shaft rotatably mounted in said skew plate for rotation about said skew axis, a skew arm fixed to said drive shaft spaced from said skew plate, and said drive shaft being operably associated with said skew arm.

12. The saw of claim 11 in which said control arm is rotatably mounted relative to said skew plate.

13. A continuous motion saw for elongated web plies, comprising: frame means providing a linear path for said elongated web plies, conveyor means operatively associated with said frame means for continuously advancing said elongated web plies along said linear path, a relatively elongated drive arm rotatably mounted on said frame means, a blade mounted on said drive arm, means on said frame means for rotating said drive arm about an axis skewed with respect to said linear path, said drive arm rotating means being connected to said drive arm intermediate the length thereof, bracket means adjacent an end of said drive arm to provide two degrees of pivotal freedom and carrying said blade, means on said bracket means for rotating said blade, rotation of said drive arm orbiting said blade and the blade orbit intersecting said linear path, and control means rotatably mounted on said frame means for rotation about an axis eccentric to said drive arm axis, said control means being connected to said bracket means for compensating for the skew of said drive arm to orient said blade perpendicular to said web plies in said linear path when engaging the same, said bracket means being equipped with a grinding stone for said blade, said grinding stone being positioned radially inwardly of said blade during the entire blade orbit whereby centrifugal forces are reduced and cyclic loading is substantially eliminated, said two degrees of pivotal freedom of said bracket means including means providing first for rotation about a first axis generally parallel to the length of each of said drive arm and said control arm and second for rotation about a second axis perpendicular to said first axis and generally perpendicular to said skewed axis, said rotation-providing means including clutch means to maintain a constant forward index motion.

14. A continuous motion saw for cutting elongated web plies into lengths comprising: frame means providing a linear path for said elongated web plies, conveyor means operatively associated with said frame means for continuously advancing said elongated web plies along said linear path, a relatively elongated drive arm having a pair of ends and rotatably mounted on said frame means, a blade mounted on each end of said drive arm, means on said frame means for rotating said drive arm about an axis skewed with respect to said linear path, a pair of brackets, one said bracket connected adjacent each end of said drive arm to provide two degrees of pivotal freedom and carrying one of said blades, means on each said bracket for rotating he blade thereon, rotation of said drive arm orbiting the blade thereof and the blade orbit intersecting said linear path, and a relatively elongated control arm having a pair of ends rotatably mounted on said frame means adjacent said blade drive arm for rotation about an axis eccentric to said drive arm axis, each end of said control arm connected to one of said brackets for two degrees of pivotal freedom, the rotation of both of said arms orienting said blades perpendicular to said linear path, each said bracket being equipped with a grinding stone for its associated blade, said grinding stone being positioned radially inwardly of its associated blade during the entire blade orbit whereby centrifugal forces are reduced and cyclic loading is substantially eliminated, said two degrees of pivotal freedom of each bracket including means providing first for rotation about a first axis generally parallel to the length of each of said drive arm and said control arm and second for rotation about a second axis perpendicular to said first axis and generally perpendicular to said skewed axis, said rotation-providing means including clutch means to maintain a constant forward index motion.

15. The slaw of claim 14 in which means are interposed between said control arm and frame means for adjusting the eccentricity of said control arm axis relative to said drive arm axis for changing the cut length of said elongated web plies.

16. The saw of claim 15 in which a skew plate is mounted on said frame means to define said skew axis, said means for rotating said drive arm including a drive shaft rotatably mounted in said skew plate and carrying said drive arm, said adjusting means including bearing means for said control arm, said bearing means being rotatably mounted on said skew plate for adjusting said eccentricity.

17. The saw of claim 16 in which said bearing means has an arcuate slot-equipped flange to provide for adjusting said eccentricity.

* * * * *